US010413106B1

(12) United States Patent
Valeriano et al.

(10) Patent No.: US 10,413,106 B1
(45) Date of Patent: Sep. 17, 2019

(54) PACKAGE DOOR FOR A GARAGE DOOR

(71) Applicants: Philip Valeriano, Las Vegas, NV (US); Daniel Hennigan, Manlius, NY (US)

(72) Inventors: Philip Valeriano, Las Vegas, NV (US); Daniel Hennigan, Manlius, NY (US)

( * ) Notice: Subject to any disclaimer, the term of this patent is extended or adjusted under 35 U.S.C. 154(b) by 0 days.

(21) Appl. No.: 16/355,448

(22) Filed: Mar. 15, 2019

(51) Int. Cl.
*A47G 29/14* (2006.01)
*E06B 7/32* (2006.01)
*E06B 3/70* (2006.01)

(52) U.S. Cl.
CPC ..... *A47G 29/14* (2013.01); *A47G 29/141* (2013.01); *E06B 7/32* (2013.01); *A47G 2029/145* (2013.01); *A47G 2029/149* (2013.01); *E06B 2003/7011* (2013.01); *E06B 2003/7044* (2013.01)

(58) Field of Classification Search
CPC ..... A47G 29/14; A47G 29/141; E06B 7/32; E06B 2003/7011; E06B 2003/7044
See application file for complete search history.

(56) References Cited

U.S. PATENT DOCUMENTS 1,671,611 A * 5/1928 Rossman ..... A47G 29/14 232/1 R
2,829,820 A * 4/1958 Evers ..... A47G 29/1223 232/19
3,874,118 A * 4/1975 Robinson ..... E06B 7/32 119/484
4,826,075 A 5/1989 Burns
5,029,753 A 7/1991 Hipon et al.
5,161,328 A * 11/1992 Traue ..... E06B 7/30 49/171
5,287,654 A * 2/1994 Davlantes ..... A01K 1/035 47/56
5,492,272 A 2/1996 Fewer
5,897,053 A 4/1999 Cirimele
6,987,452 B2 1/2006 Yang
7,240,823 B1 7/2007 Saidiazar
7,246,562 B2 * 7/2007 Lee ..... E06B 7/32 108/167
7,484,286 B2 * 2/2009 Fowler ..... E06B 3/7001 160/104
8,999,478 B1 * 4/2015 Medlen ..... E06B 3/7001 428/99
9,619,955 B2 * 4/2017 Eichenblatt ..... A47G 29/141
9,926,737 B2 * 3/2018 Wanjohi ..... A47G 29/126
9,955,812 B2 * 5/2018 Charbeneau ..... A47G 29/141
2002/0070269 A1 6/2002 Rosiello et al.
2009/0241422 A1 * 10/2009 Mock ..... E06B 3/5892 49/197
2017/0328098 A1 * 11/2017 Ben-Zion ..... E05C 17/025
2018/0142514 A1 * 5/2018 Alvarez ..... E06B 3/5892
2018/0199745 A1 * 7/2018 Charbeneau ..... A47G 29/141
2018/0317687 A1 * 11/2018 Crooks ..... A47G 29/12

* cited by examiner

*Primary Examiner* — Catherine A Kelly
(74) *Attorney, Agent, or Firm* — Weide & Miller, Ltd.

(57) ABSTRACT

A garage door includes a package delivery door. The package delivery door is located at an opening through a panel of the garage door. The package delivery door comprises a frame which defines a package delivery opening and a delivery door which is movable between a first position in which it closes the package delivery opening and a second position in which it does not. In the second position, the door may serve as a ramp for sliding package into the garage space behind the garage door. A stop limits rotation of the delivery door to the second position. The package door may be lockable and include a bar code scanner.

15 Claims, 5 Drawing Sheets

PACKAGE DOOR FOR A GARAGE DOOR

FIELD OF THE INVENTION

The present invention relates to methods and devices for receiving and securing packages.

BACKGROUND OF THE INVENTION

More than ever, consumers are receiving goods via delivered packages. Online shopping, such via online vendors such as Amazon, has increased the volume of package deliveries to consumers.

One problem associated with package delivery is how to ensure that the packages are securely delivered. As the rate of package delivery has risen, so has the rate at which packages are stolen by thieves. However, existing methods of securely delivering packages have various drawbacks.

For example, in some cases the package sender may require the delivery company to deliver the package to the consumer in person and obtain a signature from the consumer confirming the delivery. As consumers know, this arrangement can be very inconvenient as it either requires them to be at the delivery location when the delivery is made or requires them to travel to a package facility to pick up their package in person.

As one attempt at securing packages, Amazon has created secure package drop-off and delivery locations for their customers. These "lockers" are secure package drop-off and delivery sites, much like postage boxes that can be found inside U.S. Postal Service locations. As with U.S. Postal Service locations, however, for a consumer to use one of these lockers, they must either travel to the locker to deposit their package (such as for a product return) or travel to the locker to pick up their package. This can be inconvenient and, particularly for the elderly and those with disabilities and the like, not an option.

An improved method and system for securing the delivery of packages is desired.

SUMMARY OF THE INVENTION

Aspects of the invention comprise garage door which includes a package delivery door, a package delivery door kit, a method of making or modifying a garage door to include a package delivery door, and a method of using a package deliver door which is associated with a garage door. In general, the package delivery door allows packages to be delivered into a garage space through a package delivery door which is provided in the garage door.

One embodiment of the invention comprises a garage door with a package delivery door comprising a garage door panel having a front and a back and a panel opening and a package delivery door mounted to the garage door panel. The package delivery door comprises a door frame connected to the garage door panel and defining a package delivery opening therethrough, the door frame having a top, a bottom, a first side and a second side; a delivery door comprising a panel supported by a panel frame, the delivery door having a top and a bottom, the bottom of the delivery door rotatably mounted to the door frame and movable between a first closed position in which the delivery door generally closes the package delivery opening and a second position in which the delivery door is rotated into a garage space behind the back of the garage door panel; at least one biasing device configured to bias the delivery door and a door stop, a position of the door stop adjustable relative to the door frame.

In one embodiment, the door frame comprises a front frame member which is located the front of the garage door panel and a rear frame member which is located at the rear of the garage door panel. The at least one biasing device may comprise a spring which is associated with a hinge which connects the delivery door to the door frame.

In one embodiment, a garage door may be formed with a package delivery door at the time the garage door is manufactured. In other embodiments, a garage door may be retrofit with a package delivery door. In a retrofit configuration, the package delivery door may be sold as a kit which is installed in a panel opening which is cut in an existing door.

In use, a package delivery person simply pushes a package through a package delivery opening defined by the door. When the package is pushed through the door, the delivery door preferably rotates into the garage space behind the door. The panel of the delivery door may form a ramp which allows the package to slide into the garage.

The package delivery door may include other features, including a lock, scanner or reader for reading information such as barcodes, and a package catch.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Aspects of the invention comprise a package delivery door, such as for a garage door, a method of using the package delivery door, and methods of making or modifying a garage door to include a package delivery door. The term "package" as used herein is generally meant to comprise an object which comprises an enclosure which houses an object therein, such as a box which houses or encloses an item. The term includes objects such as parcels, envelopes, boxes and other containers or the like which are used to transport objects (such as items which are ordered for delivery from one location to another). The present invention has particular utility to packages which are delivered to consumers, but has applicability to packages which are delivered to businesses or other entities/locations.

Figure 1:
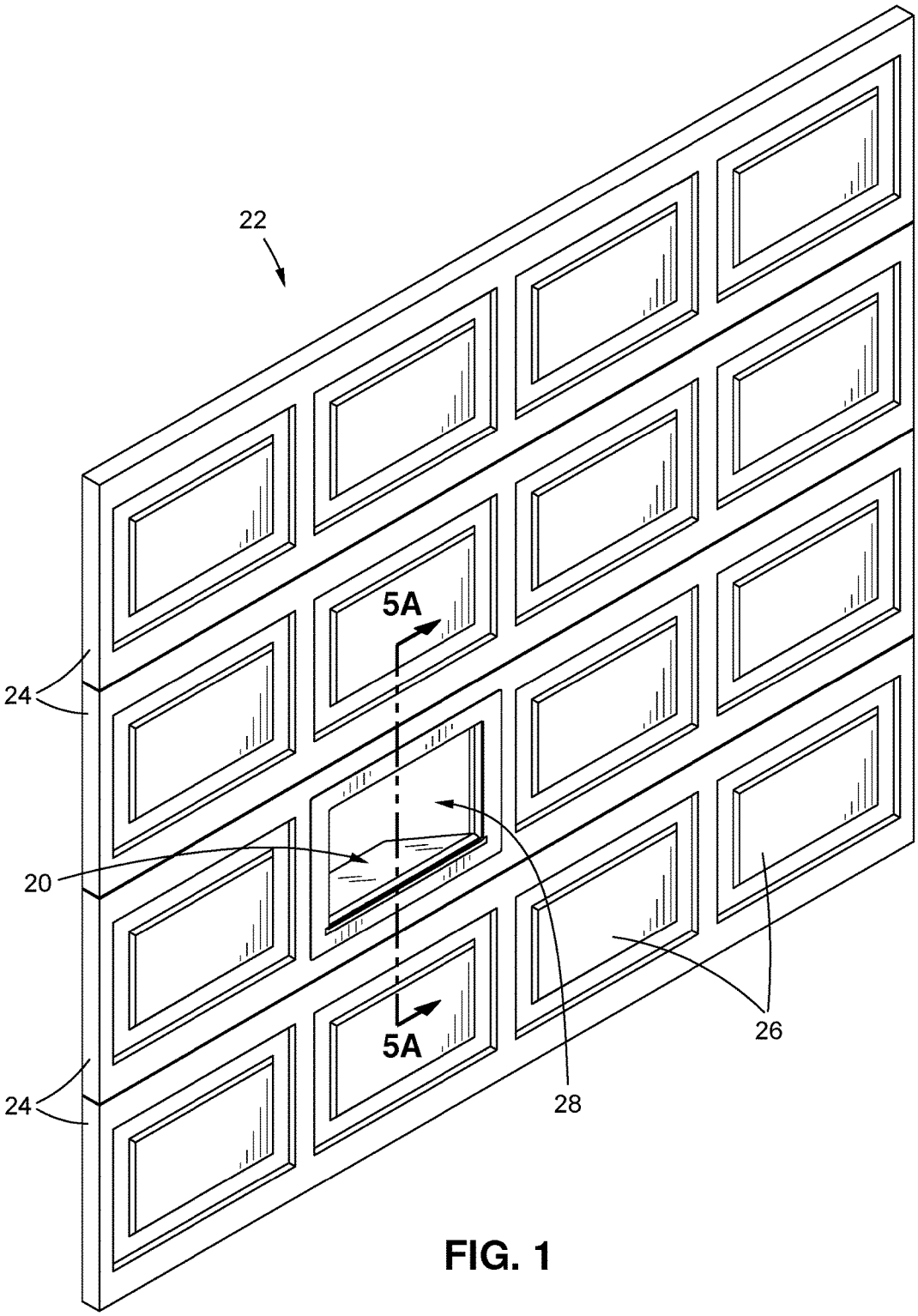
FIG. 1 is a perspective view of a front of a garage door which includes a package delivery door in accordance with an embodiment of the invention.
Figure 2:
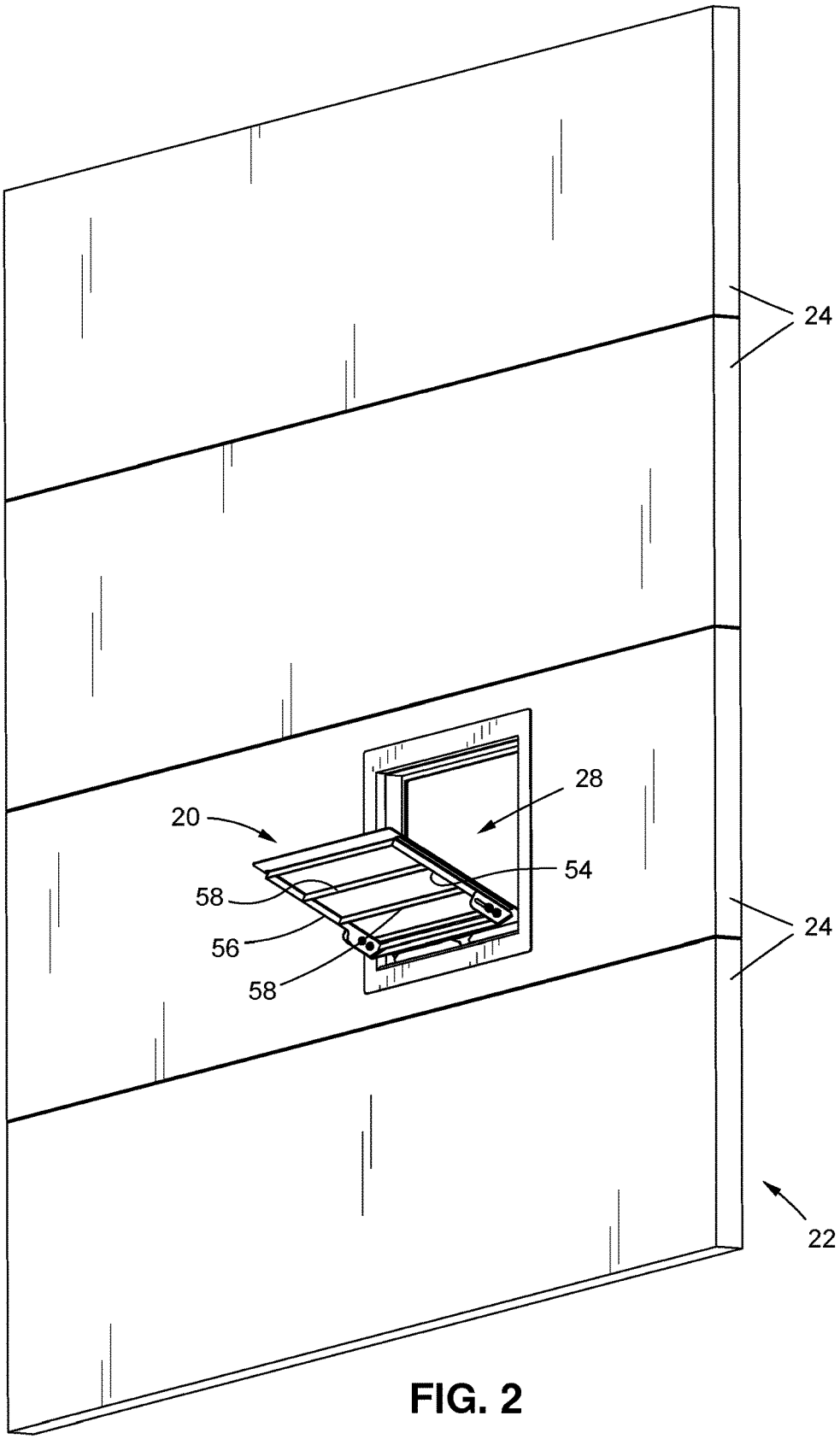
FIG. 2 is a rear view of the garage door and package delivery door which is illustrated in FIG. 1.

FIGS. 1 and 2 illustrate one embodiment of the invention, which comprises a package delivery door 20 for a garage door 22. FIG. 1 illustrates the garage door 22 from a front, while FIG. 2 illustrates the garage door 22 from the rear. As described below, while the invention has particular utility to a garage door 22, the invention has applicability to other environments.

The garage door 22 may have various configurations as is known in the art. As is conventional, the garage door 22 is configured to selectively enclose a garage of a location, such as a garage of a house. Such a garage door 22 is known to have a wide variety of configurations, may be constructed from a wide variety of materials, may be configured to open and close in various manners (roll or swing up, slide, rotate out, etc.) and the like.

FIGS. 1 and 2 illustrate a configuration in which the garage door 22 comprises a plurality of generally horizontally oriented main panels 24. These main panels 24 are hingedly connected (not shown), thus allowing the garage door 22 to be raised and lowered along a track that causes the garage door 22 to be moved from a generally vertical position (such as where the garage door closes an otherwise open front of a garage) to a generally horizontal position (such as where the garage door is positioned the garage near a ceiling thereof). In the embodiment which is illustrated in FIG. 1, at least a front of each main panel 24 has or defines a plurality of decorative sub-panels 26. Such sub-panels 26 may be raised, inset or the like, relative to the main panel 24. However, the main panels 24 could be flat or the like. Of course, the garage door 22 might have other configurations, such as comprising only one large panel, a plurality of vertically oriented panels or the like.

As illustrated in FIGS. 1 and 2, in one embodiment, package delivery door 20 is configured to be associated with a main panel 24 of the garage door 22, and most preferably one of the decorative sub-panels 26. In one embodiment, a panel or door opening 36 is provided in the garage door 22, such as through one or more of the decorative sub-panels 24. The package delivery door 20 is mounted to the garage door 22 at the panel opening 36 and defines a package delivery opening 28 which is selectively openable and closeable. In particular, as described in more detail below, the package delivery door 20 can be moved from a closed position in which it generally block or closes the delivery opening 28, to an open position (as illustrated in FIGS. 1 and 2) in which the delivery opening 28 is open and allows one or more packages to pass therethrough.

Figure 3:
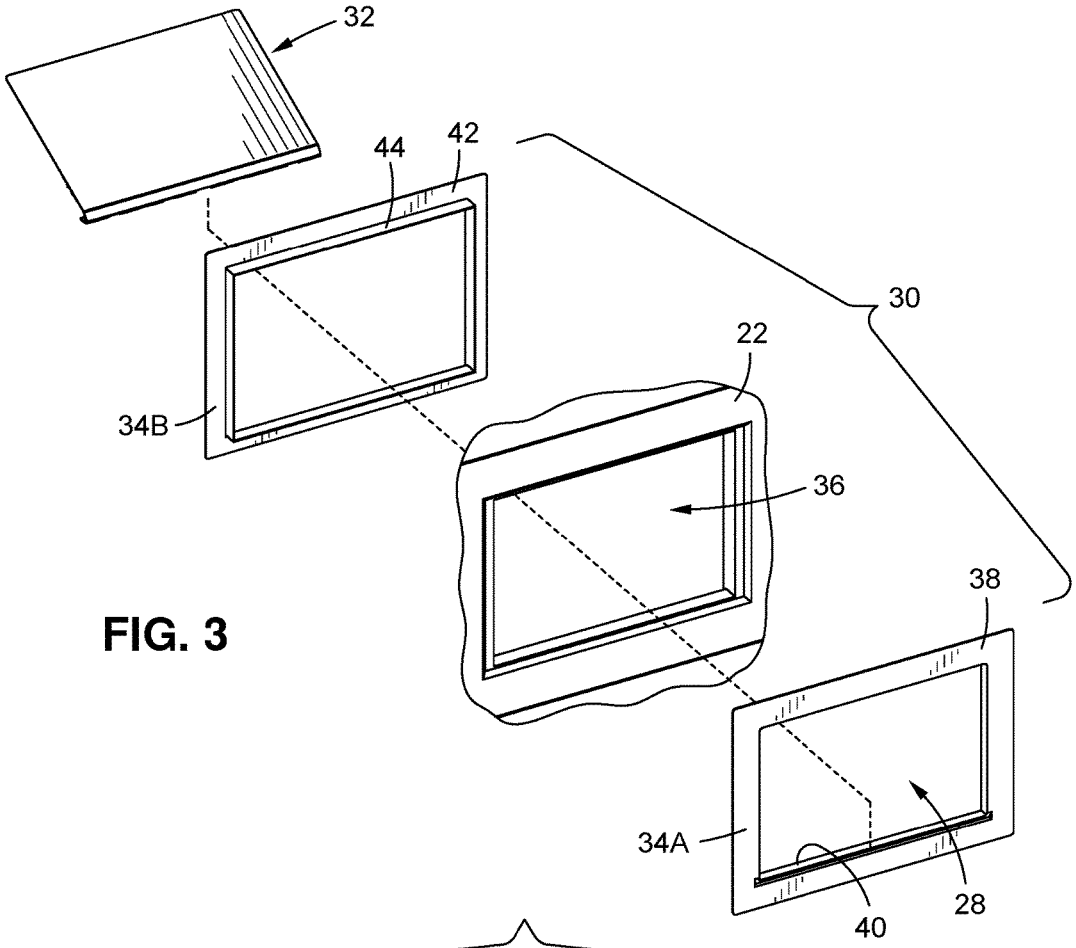
FIG. 3 is an exploded view of an assembly of the garage door and package delivery door illustrated in FIG. 1.
Figure 4:
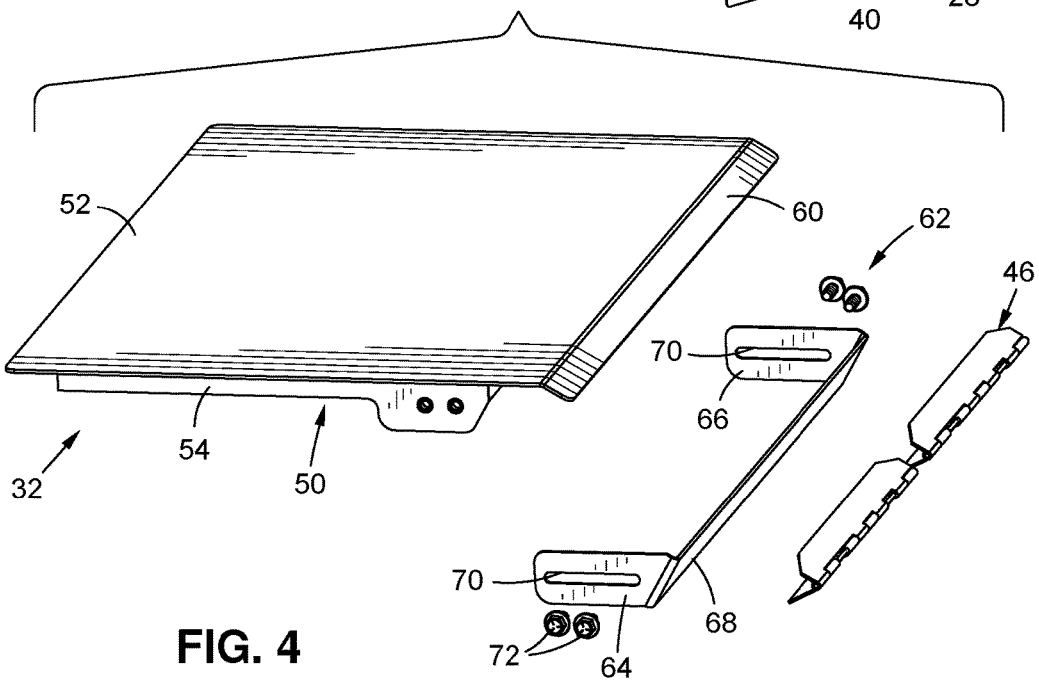
FIG. 4 illustrates components of the package delivery door in accordance with one embodiment of the invention.

As illustrated in FIG. 3, in one embodiment the package delivery door 20 comprises a frame 30 and a delivery door 32. In one embodiment, the frame 30 comprises a front frame 34A and a rear frame 34B. As indicated, a door or panel opening 36 is provided in the garage door 22. The door opening 36 might be pre-formed in the garage door 22, such as during original manufacturing of the panel 24 of the door 22. Alternatively, the panel or door opening 36 might be cut into an existing garage door 22, such as using a saw.

The frame 30 is associated with the door opening 36 and defines the delivery opening 28. In general, in one embodiment the front frame 34A is designed to be located at the front of the garage door 22 and defines a first opening, and the rear frame 34B is designed to be located at the rear of the garage door 22 and defines a second opening, wherein the first and second openings of the front and rear frames 34A,B define the delivery opening 28 (which essentially comprises a sub-part of the panel or door opening 36 through the garage door 22).

In one embodiment, the front frame 34A comprises a frame body 38. The frame body 38 may be generally planar and have a shape which generally corresponds to the desired shape of the door opening 36 and the delivery opening 28. In this case, the door opening 36 and the delivery opening 28 are both generally rectangular, so the frame body 38 has a similar shape. The front frame 34A also has a rearwardly extending flange 40. This flange 40 preferably extends from a back or rear side of the frame body 38. In one embodiment, the flange 40 extends around the entire circumference of the frame body 38 at the delivery opening 28. In this configuration, the frame body 38 and flange 40 both have a pair of generally vertically extending sides connected by a top and an opposing bottom.

The dimensions of the front frame 34A may vary. In one embodiment, the delivery opening 28 is approximately 18 inches wide and 12 tall/high and the frame body 38 extends outwardly around the delivery opening 28 about 2 inches. The flange 40 extends rearwardly from the frame body 38 by about 1.5 inches.

Figure 5A:
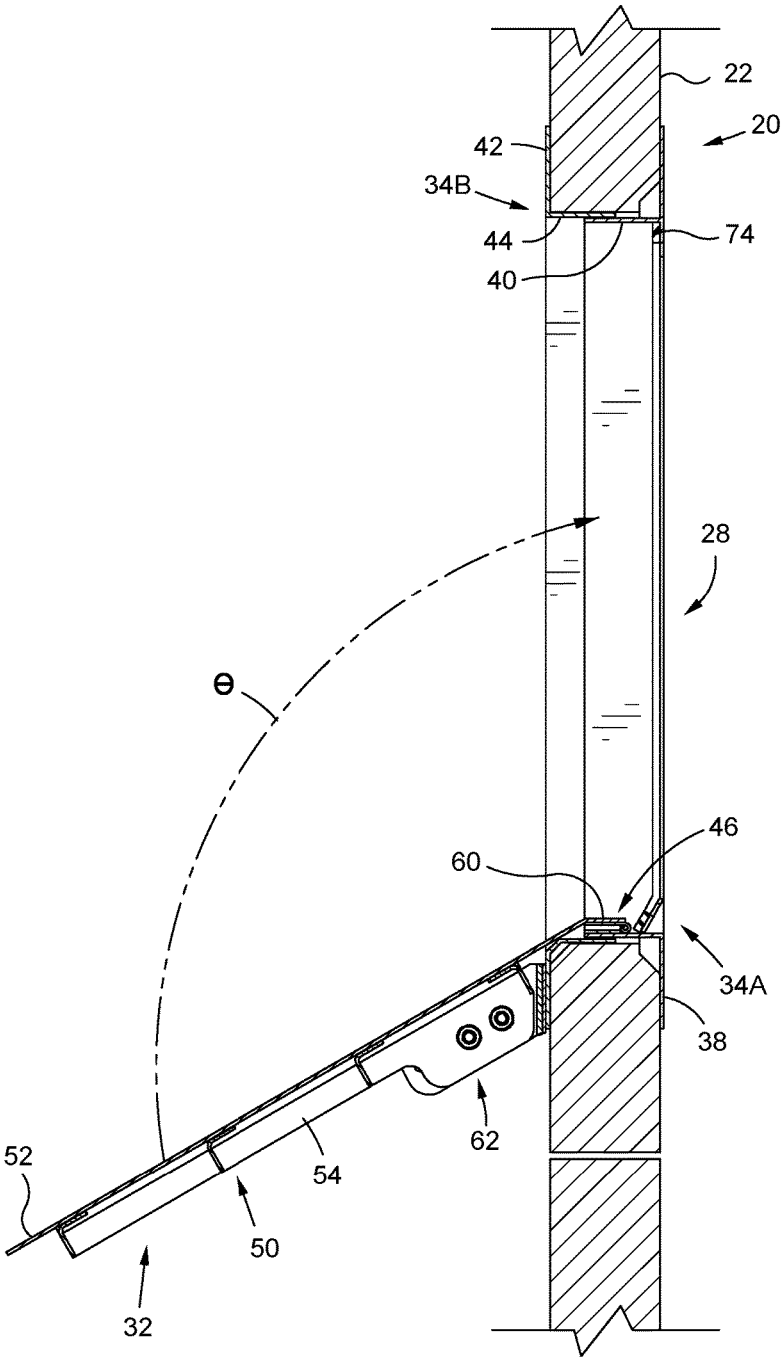
FIGS. 5A and 5B illustrate the package delivery door of FIG. 1 in open and closed positions.
Figure 5B:
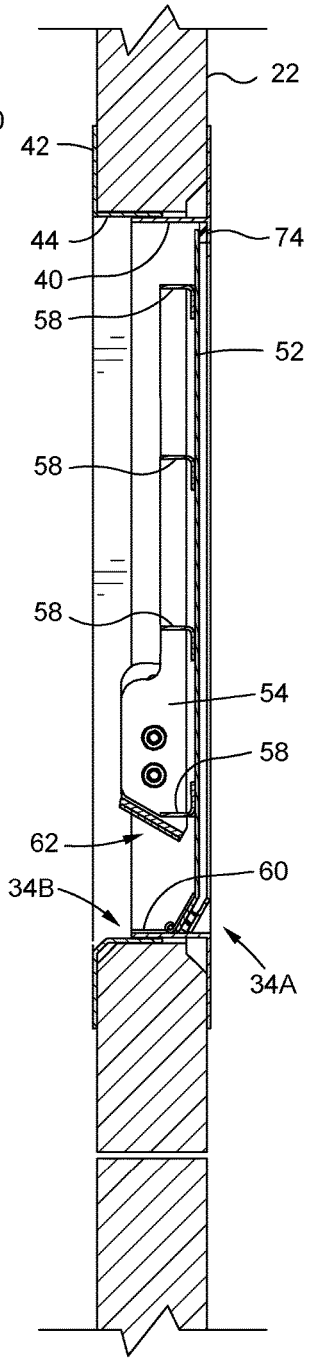

The rear frame 34B also comprises a frame body 42 and flange 44. The rear frame 34B may be similar in shape and dimensions to the front frame 34A. As illustrated in FIGS. 5A and 5B, in one embodiment the dimensions of the flange 40 of the front frame 34A are slightly smaller than those of the flange 40 of the rear frame 34B, whereby the flange 40 of the front frame 34A may slide into the flange 44 of the rear frame 34B in an overlapping fashion.

As illustrated in FIGS. 3 and 5A, in one embodiment the delivery door 32 is mounted to the flange 40 of the front frame 34A, such as at a bottom portion thereof, as described in more detail below. The delivery door 32 is preferably mounted to the frame 30 in a manner which permits movement of the delivery door 32 between a first, closed position and a second, open position. In one embodiment, the delivery door 32 is mounted to the frame 30 via at least one hinge 46. The hinge 46 may have a first mount and a second mount which are connected about a pivot, such as a shaft. The first mount may be connected to the frame 30 and the delivery door 32 may be connected to the second mount. In a preferred embodiment, the hinge 46 is biased to an open position, such as via one or more springs or other biasing mechanisms.

In one embodiment, the delivery door 32 comprises a support 50 and a panel 52. As best illustrated in FIG. 1, the support 50 may comprise first and second arms 54,56 and a plurality of struts or cross-supports 58. The arms 54,56 are spaced apart and each have a first or bottom end and a second or top end. When the delivery door 32 is mounted to the garage door 22, the bottom ends of the arms 54,56 are located near the hinge 46 and the top ends of the arms 54,56 are located towards the top end of the delivery door 32. The struts 58 extend between the arms 54,56. In the embodiment as illustrated, there are four struts 58, one near the top of the arms 54,56, one near the bottom of the arms, and two struts therebetween.

The panel 52 comprises a generally planar body. The panel 52 is sized and shaped so that when the delivery door 32 is in the closed position, the panel 52 closes the delivery opening 28. Thus, where the delivery opening 28 is about 18 inches high and 12 inches wide, the panel 52 has nearly the same dimensions (but is slightly smaller so that it fits into the frame 30 which defines the delivery opening 28).

The frame 30 supports the panel 52. As illustrated, the first and second arms 54,56 of the frame 30 extend along the sides of the panel 52 and the struts 58 extend across the width of the panel 52. As illustrated, the panel 52 is mounted to a front side of the frame 30 which faces the delivery opening 28 and the front of the garage door 22.

The delivery door 32 is mounted to the hinge 46, as best illustrated in FIG. 5A. In one embodiment, a bottom portion of the panel 52 is connected to one of the mounts of the hinge 46. As illustrated, the panel 52 may have a flange portion 60 at a bottom thereof. The flange portion 60 may extend at an angle relative to the remaining generally planar portion of the panel 52. The flange portion 60 may be angled to that it connects to the hinge 46 and permits movement of the delivery door 32 to an extended opening position as illustrated in FIG. 5A.

In one embodiment, the delivery door 32 includes an adjustable stop 62. The adjustable stop 62 may comprise a body which is mounted to the delivery door 32, such as the support 50, and which is designed to contact the rear of the garage door 22 when the delivery door 32 is moved to the open position. The adjustable stop 62 may be used to limit the rotation of the delivery door 32 into the open position.

In one embodiment, the adjustable stop 62 comprises a pair of mounting tabs 64,66 at either end of a stop body 68. Each mounting tab 64,66 preferably defines an elongate slot 70. The stop body 68 is preferably oriented at an angle relative to the mounting tabs 64,66. As illustrated in FIG. 5A, this angle may be selected so that the delivery door 32 can be opened to a particular angle $\Theta$ before the stop body 68 contacts the rear of the garage door 22 and prevents the delivery door 68 from opening further.

In one embodiment, the adjustable stop 62 is mounted to the arms 54,56 of the support 50 in an adjustable fashion. In particular, in a preferred embodiment, one or more fasteners 72 may be passed through the slots 70 in the mounting tabs 64,66 and into engagement with the arms 54,56. The position of the adjustable stop 62 relative to the delivery door 32 may be adjusted by sliding the adjustable stop 62 and arms 54,56 relative to one another via movement of the fasteners 72 along the slots 70 (before tightening the fasteners to fix the adjustable stop 62 into a fixed position). As described below, the ability to change the position of the adjustable stop 62 facilitates mounting of the delivery door 32 on garage doors having different thicknesses (such as to insulated and non-insulated doors) while still controlling the opening of the delivery door 32 to the desired angle $\Theta$.

Additional aspects of the invention, including the use thereof, will now be described. As described above, a garage door 22 may be manufactured with the package delivery door 20 already installed, whereby once the garage door 22 is installed, the package delivery door 20 is ready for use.

Alternatively, an existing garage door 22 may be retrofit with the package delivery door 20. In one embodiment, the package deliver door 22 might be sold as a kit. Such a kit might include the frame 30 with the door 32, a mounting template, mounting hardware (screws, etc.), and one or more seals or the like. As indicated, the door opening 36 may be cut into the garage door 22. For example, a template that is provided with the package delivery door 20 might be used by the end user as a guide to cutting the appropriate sized hole. As indicated in FIG. 1, the package delivery door 20 may be sized so that it corresponds to one of the decorative panels 26 of the garage door 22 and thus fit into the space normally occupied by one of those panels.

Once the hole is cut in the door, the user may install the rear frame 34B and connect it to the rear of the garage door 22, such as with one or more fasteners (screws, etc.) The user may then mount the front frame 34A at the front of the garage door 22. As illustrated, the front frame 34A may be designed to slide into the flange 44 of the rear frame 34B. The user may then fix the front frame 34A (and the delivery door 32 which is mounted thereto), such as with fasteners. In one embodiment, to prevent fasteners from being visible at the front of the door, the front frame 34A may be mounted by passing fasteners through the flange 40 and into engagement with the rear frame 34B.

In one embodiment, a gasket or seal may be located between the rear frame 34B and the rear of the garage door 22 and the front frame 34A and the front of the garage door 22. These gaskets, which might comprise foam, rubber or the like, may aid in sealing the frame 30 to the garage door 22. The user may paint the package delivery door 20, such as the panel 52 and front frame 34A so that they match the color of the garage door 22.

Referring to FIGS. 5A and 5B, in a normal state, the delivery door 32 is biased to its closed position (such as via the one or more springs of the hinge 46). In this position, the panel 52 is rotated upwardly into the delivery opening 28 until it hits the front frame 34A, such as at a stop 74 thereof (the stop 74 may, for example, extend into the delivery opening 28 circumferentially around the front frame 34A, whereby the stop 74 slightly overlaps the panel 52 when the delivery door is closed). At this time, the delivery opening 28 is not visible or accessible and the garage door 22 may not look like it is altered in any way.

In one embodiment, the hinge 46 may be designed as a slow-closing hinge so that the delivery door 32 closes slowly. This prevents, for example, the panel 52 from slamming shut and catching a person's hand or the like.

When a package is to be delivered, the delivery person simply opens the delivery door 32 and pushes the package through the delivery opening 28. In one embodiment, the delivery person can press upon the panel 52 with their hand or the like in order to move it. In a preferred embodiment, however, the delivery person simply presses the package against the panel 52, causing it to rotate open.

In particular, as illustrated in FIG. 5A, the delivery door 32 can be rotated to a position in which it extends into the garage behind the garage door 22. In this position, the delivery opening 28 is not obscured, allowing the package to be pushed through the delivery opening 28 into the garage.

As illustrated in FIG. 5A, the delivery door 32 can preferably be opened to an angle $\Theta$. In a preferred embodiment, this angle is approximately 120 degrees. In this position, as illustrated, the panel 52 defines a smooth sloping ramp which angles slightly downwardly from horizontal towards the ground/floor. Most importantly, this slope keeps packages at an angle close enough to horizontal so that as the front of the package moves through the delivery opening 28, the rear of the package does not rise up against the top of the frame 30 and bind, wedging the package in the opening 28. Further, the slope facilitates the package sliding into the garage. This allows a package delivery person to push the package through the delivery opening 28 with one hand.

Once the package has passed through the delivery opening 28, it falls to the ground inside of the garage behind the garage door 22. At this time, the package is securely located within the garage (and is thus not visible or accessible to third parties) and is protected from the elements (such as sun/rain/snow, etc.). The delivery door 32 is then biased back from its open position to its closed position.

So described, the package delivery door 20 solves problems associated with the prior art, including by readily securing packages to be delivered without a requirement that the customer be available to accept delivery. The package delivery door 20 has other advantages as noted herein. In addition, one aspect of the package delivery door 20 is that the panel 52 forms a package delivery ramp when it is in its open position, but when closed it does not extend outwardly of the garage door. This ensures that the delivery door 32 does not interfere with the movement of the garage door between its open and lowered position and does not pose a risk of harm to the user (e.g. the user will not run into the delivery door 32 when walking through the inside of the garage or the like).

One advantage to the package delivery door 20 is that its design allows a user to hold and push a package through the door without having to hold the door open. If the delivery person had to use one hand to open the delivery door 32, they would only have one hand to try and hold and guide the package through the door 32. This could result in the delivery person dropping the package or the like. In accordance with the design of the package delivery door 20 noted herein, the delivery person can keep both hands on the package and simply push the package against the door 32 to open it and then slide the package through the delivery opening 28.

Another advantage to the invention is that the package delivery door 20 can be used to secure an almost limitless number of packages and packages of different sizes and shapes. Even in the prior art where packages are delivered to a protected or secured area such as a mailbox, the size of the mailbox often limits the size of the package which can be securely delivered and/or limits the number of packages which can be delivered. In accordance with the invention, package delivery door 20 allows the interior of the use's garage to comprise the secure delivery area. Given the size of most garages, this allows for the secure delivery of packages of various sizes including very large packages, as well as very large numbers of packages. Thus, for example, if a user is on vacation and receives multiple package deliveries, all of those packages may be securely deposited in the user's garage.

The package delivery door 20 may be constructed from various materials, such as metal, plastic, composites or combinations thereof. The components thereof might be colored or might later be painted.

The package delivery door 20 may include other features or elements.

In one embodiment, the package deliver door 20 might include a lock. The lock might be mechanical and/or electro-mechanical. For example, a key-operated manual lock might be provided. Such a lock might include a lock cylinder which is accessible from the front of the garage door and which can be rotated with a key to move a locking tab which is positioned at the rear of the garage door. The locking tab might be moved from a position in which it does not impede movement of the deliver door 32 to an open position to one where it prevents it from being opened. A user might, for example, lock the package delivery door 20 when they are away for long periods in order to prevent it from being opened/used. In other configurations, a package delivery person might be provided with the key so that they may unlock and use the door (or the delivery person might be provided with a universal key which fits all package door locks, thus enabling the delivery person to use a single key to open doors belonging to different users).

In electro-mechanical variations, the lock might include a finger print sensor, a keypad or other input device which allows the user to control which parties can unlock the door. For example, the lock might include a battery-operated keypad into which a code may be input which causes a signal to be provided to a motor which locks and unlocks the lock (such as a servo-motor which turns the lock cylinder and thus the locking tab). In some embodiments, the lock might include a communication interface and a processor and may be configured to receive instructions from a remote device, such as a smart phone or remote type, such as via a wireless link (Bluetooth, Wi-Fi, infrared, etc.) In some embodiments, the consumer or a delivery person may utilize an application on their smart phone to communicate with this sort of smart lock, thus allowing them to unlock the lock. As one example, the consumer or the delivery person might input an access code into the application running on their mobile device, which access code is then transmitted to the lock of the door or causes the mobile device to send an unlock command to the lock. Such an application or remote device might, for example, allow the consumer to remotely lock and unlock the package delivery door 20.

Of course, the lock might have other configurations or features. For example, instead of a rotating lock, sliding bars or other elements may be utilized for preventing movement of the delivery door 32 to the open position. Also, in one embodiment the lock might be self-locking. As one example, the lock might be configured so that one the delivery door 32 is opened and then closed, the door locks. For example, a user might unlock the package delivery door 20 in the morning, knowing that a package is set to arrive that day. Once the package is delivered, the door would then lock itself, thus ensuring that the delivered package is secured. In this configuration, a sensor might be utilized to detect movement of the delivery door 32 to its open position or detect, as detailed below, delivery of a package. Such a sensor might then send an output to a processor which operates the lock.

In one embodiment, the package delivery person might be provided with a FOB or other device which transmits an "unlock" signal (such as an unlock code). The package delivery person might press a button to cause the FOB, remote or other device to transmit the unlock signal or code, or the device might continuously transmit such a signal or code. In this manner, as the package delivery person approaches the package delivery door 20, it may be unlocked (in the case of a continuously transmitting device, without the delivery person even having to access and trigger the device).

In one embodiment, a user might download an application to their mobile communication device. This application may sync to the user's "smart" package delivery door 20, such as allowing the user to set various settings and remotely lock and/or unlock the door. The user might also set preferences, such as whether particular delivery companies may automatically unlock the door. As one example, the user might select "allow Fed Ex to remotely unlock your door" in the application settings. If the user selects this setting, the application might cause the user's device to send instructions to a central server. The central service might then communicate with a server or other computing device of Fed Ex by which the user's door and an unlock code are provided. The user's door ID and unlock code might then be programmed to the Fed Ex delivery person FOBs or other devices, thus allowing the delivery person to remotely unlock the user's door. Of course, in other embodiments, the user might directly provide such information to the delivery company or delivery person (such as by logging into a Fed Ex website where the user can input their door ID and an unlock code for use by Fed Ex in remotely unlocking the door).

The package delivery door 20 might also include monitoring features. For example, one or more image capture devices, such as cameras, may be associated with the package delivery door 20. The image capture devices could be used to capture the image of a person approaching the door (such as by facing out of the front of the garage door) or be configured to capture the image of the rear of the garage door, and thus the opening of the delivery door 32 and any packages being delivered. The image capture devices might save captured image information on one or more data storage devices (such as memory cards or sticks) and/or might be configured to transmit the capture image data to remote devices, such as a user's computer or phone (in one embodiment, image captured by the image capture device or a triggering alert might be sent from the door to a remote server for processing and then transmission to the user's device). In one embodiment, when activity is detected by the image capture device(s), an alert and/or captured image data might be sent to the user's device. In this manner, a user might be alerted when the package door has been used (and might, for example, then go check their garage for a package) or they might actually see a package delivery person approaching the package delivery door 32 and then opening the door and delivering a package. Relative to the lock feature described above, at the point where a user is alerted to the presence of a package delivery person, the user might remotely unlock the door to allow them to deposit the package and then remotely re-lock the door.

In one embodiment, the package delivery door 20 might include a package detector. Such a detector might comprise one or more image capture devices which detect a package being delivered through the door. Separately, or in addition, such a detector might comprise a scanner, such as a bar code scanner. The scanner might detect and read a bar code of a package which is being delivered through the package delivery door 20 (for example, the scanner might be associated with the panel 52 wherein the panel 52 includes a scanning window and the bar code is read as the package passes along the panel 52 and over the scanning window). The scanned bar code might be transmitted to the user, the shipper and/or the delivery person (such as to their smart phone or over a network to a central facility or the like). In one embodiment, such a device might be used to confirm delivery of the package to the user via the door.

In one embodiment, the reader/scanner might be configured to scan information which is located in a specific location on the package, or relative to a particular package orientation. For example, the reader/scanner might be located at the top of the package delivery door 20 to read information which is printed on a top of the package as it passes through the delivery opening 28. Of course, this may require the package delivery person to orient the package so that the information is at the top. Thus, in other embodiments, more than one reader/scanner might be provided, such as for reading or scanning information on any side of the package.

The provision of a reader/scanner is advantageous over existing package delivery methods. Currently, for example, a package delivery person may be required to access a hand-held scanner and then manually scan a package at the time of delivery. When the package delivery door 20 includes a reader/scanner, the delivery no longer needs to utilize a hand-held scanner and does not need to scan the package, as such occurs automatically as part of simply delivering the package (by pushing the package through the delivery opening 28). As a result, a significant time savings is realized by the package delivery person, allowing them to deliver more packages per day (and reducing the delivery costs).

Figure 6:
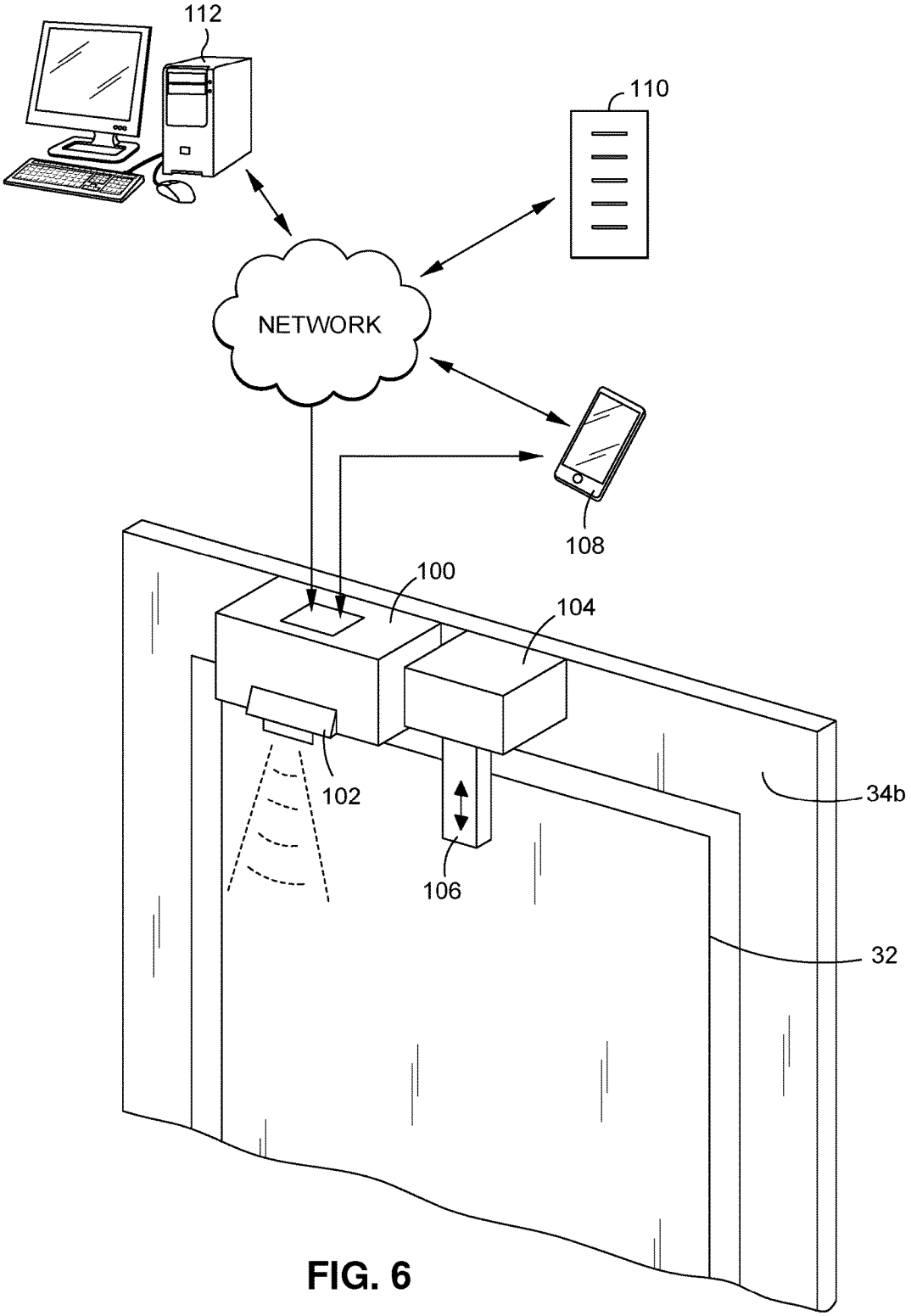
FIG. 6 illustrates other features of a package delivery door in accordance with an embodiment of the invention.

FIG. 6 illustrates one embodiment of the package delivery door 20 as including a control module 100. This module 100 might comprise, for example, a controller (such as in the form of a processor and a memory for storing instructions which are readable by the processor) and a communication interface. The module 100 might include a power source (such as one or more batteries) or be connected to a power source. The module 100 may include or communicate with a reader or scanner 102, such as a bar code scanner 102. In this embodiment, the module 100 includes a housing which is mounted to or forms a portion of the rear frame 34B, whereby the scanner 102 points downwardly to read information associated with packages passing through the package delivery door. In addition, the module 100 may include or communicate with a lock module 104. The lock module 104 may be configured to selectively move a locking element, such as a lock bar 106, from a locked position (in which it overlaps the door panel 32 and prevents the door from being opened) to an unlocked position. The lock module 104 may include, for example, a solenoid or the like for moving the lock bar 106.

In this embodiment, the controller of the module 100 may communicate with external devices directly (such as via Wi-Fi or Bluetooth) or indirectly, such as via a network. For example, the controller of the module 100 might communicate with a user's device or FOB 108 or such a device or FOB of a third party such as a deliver person, one or more servers 110, and/or one or more other computing devices 112.

In a preferred embodiment, the package delivery door 20 is mounted relatively low in the garage door 22 in order to prevent delivered packages from dropping too far from the delivery door 32 to the ground. In other embodiments, the package delivery door 20 might include a net or other mechanism for catching packages. For example, a net might be mounted at the top end of the door panel 52 so that when a delivery person pushes a package along the panel 52 it then enters the net. When the package door 32 closes, the package would be entrapped in the net which hangs inside of the rear of the garage door 22.

In a preferred embodiment, the package door 32 is hinged at the bottom. In other embodiments, it could be hinged at the top or the door could comprise two or more elements, such as one part that hinges and top and another at the bottom, with one part opening upwardly and one downwardly and then closing about a generally horizontal midline through the delivery opening 28. In yet another embodiment, the package door 32 might comprise first and second parts which are each hinged to rotate about a vertical axis.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A garage door having a package delivery door which can be operated hands-free by a package deliverer to securely deliver a package therethrough, comprising:

a garage door panel having a front and a back and a panel opening; and a package delivery door mounted to said garage door panel, said package delivery door comprising:

a door frame connected to said garage door panel and defining a package delivery opening therethrough, said door frame having a top, a bottom, a first side co-extensive with said front of said garage door panel and a second side co-extensive with said back of said garage door panel;

a delivery door comprising a panel supported by a panel frame, said delivery door having a top and a bottom, said bottom of said delivery door rotatably mounted to said bottom of said door frame and movable between a first closed position in which said delivery door is located between said first and second sides of said door frame generally closes said package delivery opening and a second open position in which said delivery door is rotated into a garage space behind said back of said garage door panel;

a door stop connected to said delivery door, a position of said door stop adjustable relative to said door frame so that in said second open position said delivery door extends away from said rear side of said garage door panel and downwardly at an angle below horizontal when said package delivery door is mounted to garage door panels having at least two different thicknesses between said front and back; and at least one biasing device configured to bias said delivery door to said first closed position, whereby a package deliverer may move said delivery door from said first closed position to said second open position by pressing a package against said delivery door at said front of said garage door panel against a force generated by said at least one biasing device and whereby the package may slide down the delivery door into a space behind said garage door, and whereby said at least one biasing device biases said delivery door back to said first closed position.

2. The garage door having a package delivery door in accordance with claim 1 wherein said door frame comprises a front frame member located at said front of said garage door panel and a rear frame member located at said back of said garage door panel, said front and rear frame members overlapping one another between said front and back of said garage door panel.

3. The garage door having a package delivery door in accordance with claim 1 wherein said delivery door is mounted to said door frame via a hinge located at said bottom of said delivery door.

4. The garage door having a package delivery door in accordance with claim 3 wherein said hinge has a first mount connected to said door frame and a second mount connected to said delivery door and said at least one biasing device biases said first and second mounts relative to one another.

5. The garage door having a package delivery door in accordance with claim 4 wherein said at least one biasing device comprises a spring which biases said first and second mounts towards one another.

6. The garage door having a package delivery door in accordance with claim 1 wherein said door stop comprises a body with a slot therein, said body mounted to said panel frame by a fastener passing through said slot.

7. The garage door having a package delivery door in accordance with claim 1 wherein said garage door panel defines a plurality of decorative sub-panels and said package delivery door is located at one of said decorative sub-panels.

8. The garage door having a package delivery door in accordance with claim 1 wherein said panel of said delivery door is generally flush with said front of said garage door panel when said delivery door is in said closed position.

9. The garage door having a package delivery door in accordance with claim 1, further comprising a code scanner mounted to said door frame and oriented to read one or more codes associated with said package being delivered through said package delivery opening.

10. The garage door having a package delivery door in accordance with claim 9, further comprising a communication interface by which information read by said scanner is transmitted to a remote location.

11. The garage door having a package delivery door in accordance with claim 1, further comprising an electromechanical lock having a lock member which is movable between a first unlocked position in which movement of said delivery door from said first closed position to said second open position is permitted and a second locked position in which movement of said delivery door from said first closed position to said second open position is prevented.

12. The garage door having a package delivery door in accordance with claim 11, wherein said lock moves said locking member to said second unlocked position when said lock detects an unlocking signal.

13. The garage door having a package delivery door in accordance with claim 12, wherein said signal is transmitted from a device associated with said package deliverer.

14. The garage door having a package delivery door in accordance with claim 1, further comprising a camera mounted to said door frame, said camera oriented to capture information at said front of said panel opening.

15. The garage door having a package delivery door in accordance with claim 1, further comprising a controller having a communication interface, and a camera, a scanner and a delivery door lock controlled by said controller, said controller, camera, scanner and lock mounted to said door frame, said controller configured to obtain information captured by said camera and scanner for transmission to one or more remote devices and said controller controlling said lock to lock and unlock said lock.

* * * * *